US006478936B1

(12) United States Patent
Volodarsky et al.

(10) Patent No.: US 6,478,936 B1
(45) Date of Patent: Nov. 12, 2002

(54) ANODE ASSEMBLY FOR PLATING AND PLANARIZING A CONDUCTIVE LAYER

(75) Inventors: Rimma Volodarsky, San Francisco, CA (US); Konstantin Volodarsky, San Francisco, CA (US); Cyprian Uzoh, Milpitas, CA (US); Homayoun Talieh, San Jose, CA (US); Douglas W. Young, Sunnyvale, CA (US)

(73) Assignee: NuTool Inc., Milpitas, CA (US)

( * ) Notice: Subject to any disclaimer, the term of this patent is extended or adjusted under 35 U.S.C. 154(b) by 0 days.

(21) Appl. No.: 09/568,584

(22) Filed: May 11, 2000

(51) Int. Cl.[7] ..... C25B 11/03

(52) U.S. Cl. ..... 204/286.1; 204/288.1; 204/288.3; 204/280; 204/275.1; 204/232; 204/297.01; 204/297.06; 204/199; 204/212; 204/213

(58) Field of Search ..... 204/199, 212, 204/213, 280, 286.1, 288.1, 288.3, 297.01, 297.06, 232, 275.1

(56) References Cited

U.S. PATENT DOCUMENTS

| | | | | |
|---|---|---|---|---|
| 3,328,273 | A | 6/1967 | Creutz et al. | 204/52 |
| 4,430,173 | A | 2/1984 | Boudot et al. | 204/52 R |
| 4,948,474 | A | 8/1990 | Miljkovic | 204/52.1 |
| 4,954,142 | A | 9/1990 | Carr et al. | 51/309 |
| 4,975,159 | A | 12/1990 | Dahms | |
| 5,084,071 | A | 1/1992 | Nenadic et al. | 51/309 |
| 5,256,565 | A | 10/1993 | Bernhardt et al. | 437/228 |
| 5,354,490 | A | 10/1994 | Yu et al. | 252/79.1 |
| 5,516,412 | A | 5/1996 | Andricacos et al. | 204/224 R |
| 5,681,215 | A | 10/1997 | Sherwood et al. | 451/388 |
| 5,755,859 | A | 5/1998 | Brusic et al. | 106/1.22 |
| 5,762,544 | A | 6/1998 | Zuniga et al. | 451/285 |
| 5,770,095 | A | 6/1998 | Sasaki et al. | 216/38 |
| 5,773,364 | A | 6/1998 | Farkas et al. | 438/692 |
| 5,793,272 | A | 8/1998 | Burghartz et al. | 336/200 |
| 5,795,215 | A | 8/1998 | Guthrie et al. | 451/286 |
| 5,807,165 | A | 9/1998 | Uzoh et al. | 451/41 |

(List continued on next page.)

FOREIGN PATENT DOCUMENTS

| | | |
|---|---|---|
| WO | 98/27585 | 6/1998 |
| WO | 00/26443 | 5/2000 |

OTHER PUBLICATIONS

Joseph M. Steigerwald et al., "Chemical Mechanical Planarization of Microelectronic Materials", A Wiley–Interscience Publication, 1997, by John Wiley & Sons, Inc. pp. 212–222. No month available.

(List continued on next page.)

*Primary Examiner*—Bruce F. Bell
(74) *Attorney, Agent, or Firm*—Crowell & Moring, LLP

(57) ABSTRACT

A particular anode assembly can be used to supply a solution for any of a plating operation, a planarization operation, and a plating and planarization operation to be performed on a semiconductor wafer. The anode assembly includes a rotatable shaft disposed within a chamber in which the operation is performed, an anode housing connected to the shaft, and a porous pad support plate attached to the anode housing. The support plate has a top surface adapted to support a pad which is to face the wafer, and, together with the anode housing, defines an anode cavity. A consumable anode may be provided in the anode cavity to provide plating material to the solution. A solution delivery structure by which the solution can be delivered to said anode cavity is also provided. The solution delivery structure may be contained within the chamber in which the operation is performed. A shield can also be mounted between the shaft and an associated spindle to prevent leakage of the solution from the chamber.

53 Claims, 7 Drawing Sheets

U.S. PATENT DOCUMENTS

| | | | | |
|---|---|---|---|---|
| 5,840,629 | A | 11/1998 | Carpio | 438/692 |
| 5,858,813 | A | 1/1999 | Scherber et al. | 438/693 |
| 5,884,990 | A | 3/1999 | Burghartz et al. | 336/200 |
| 5,897,375 | A | 4/1999 | Watts et al. | 438/693 |
| 5,911,619 | A | 6/1999 | Uzoh et al. | 451/5 |
| 5,922,091 | A | 7/1999 | Tsai et al. | 51/306 |
| 5,930,669 | A | 7/1999 | Uzoh | 438/627 |
| 5,933,753 | A | 8/1999 | Simon et al. | 438/629 |
| 5,954,997 | A | 9/1999 | Kaufman et al. | 252/79.1 |
| 5,985,123 | A | 11/1999 | Koon | 205/96 |
| 6,004,880 | A | 12/1999 | Liu et al. | 438/692 |
| 6,017,437 | A | 1/2000 | Ting et al. | 205/80 |
| 6,027,631 | A | 2/2000 | Broadbent | 205/137 |
| 6,063,506 | A | 5/2000 | Andricacos et al. | 428/546 |
| 6,066,030 | A | 5/2000 | Uzoh | 451/41 |
| 6,071,388 | A | 6/2000 | Uzoh | 204/297 R |
| 6,074,544 | A | 6/2000 | Reid et al. | 205/157 |
| 6,103,085 | A | 8/2000 | Woo et al. | 205/143 |
| 6,106,378 | A | 8/2000 | Perlove et al. | 451/288 |
| 6,113,759 | A | 9/2000 | Uzoh | 204/285 |
| 6,132,587 | A | 10/2000 | Jorne et al. | 205/123 |
| 6,136,163 | A | 10/2000 | Cheung et al. | 209/198 |
| 6,176,992 | B1 * | 1/2001 | Talieh | 205/87 |
| 6,193,859 | B1 | 2/2001 | Contolini et al. | 204/224 R |
| 6,244,942 | B1 | 6/2001 | Zuniga | 451/398 |
| 6,297,155 | B1 | 10/2001 | Simpson et al. | 438/687 |
| 6,299,741 | B1 | 10/2001 | Sun et al. | 204/224 M |
| 2001/0017258 | A1 | 8/2001 | Ishida et al. | 204/212 |
| 2001/0041526 | A1 | 11/2001 | Perlove et al. | 451/288 |

OTHER PUBLICATIONS

Robert D. Mikkola et al., "Investigation of the Roles of the Additive Components for Second Generation Copper Electroplating Chemistries Used for Advanced Interconnect Metalization", 2000 IEEE, IEEE Electron Devices Society, pp. 117–119. No month available.

James J. Kelly et al., "Leveling and Microstructural Effects of Additives for Copper Electrodeposition", Journal of the Electrochemical Society, 146 (7), 1999, pp. 2540–2545. No month available.

* cited by examiner

ANODE ASSEMBLY FOR PLATING AND PLANARIZING A CONDUCTIVE LAYER

BACKGROUND OF THE INVENTION

Multi-level integrated circuit manufacturing requires many steps of metal and insulator film depositions followed by photoresist patterning and etching or other means of material removal. After photolithography and etching, the resulting wafer or substrate surface is non-planar and contains many features such as vias, lines or channels. Often, these features need to be filled with a specific material, such as a metal, a dielectric, or both. For high performance applications, the wafer topographic surface needs to be planarized, making it ready again for the next level of processing, which commonly involves deposition of a material, and a photolithographic step. It is most preferred that the substrate surface be flat before the photolithographic step so that proper focusing and level-to-level registration or alignment can be achieved. Therefore, after each deposition step that yields a non-planar surface on the wafer, there is often a step of surface planarization.

Electrodeposition is a widely accepted technique used in IC manufacturing for the deposition of a highly conductive material such as copper into the features such as vias and channels opened in an insulating layer on the semiconductor wafer surface. FIGS. 1*a* through 1*c* show an example of a procedure for filling surface features with electrodeposited copper and then polishing the wafer to obtain a structure with a planar surface and electrically isolated copper (Cu) plugs or wires.

Features 1 in FIG. 1*a* are opened in the insulator layer 2 and are to be filled with Cu. To achieve this, a barrier layer 3 is first deposited over the whole wafer surface. A conductive Cu seed layer 4 is then deposited over the barrier layer 3. Upon making electrical contact to the Cu seed layer 4 and/or the barrier layer 3, and applying electrical power, Cu is electrodeposited over the wafer surface to obtain the structure depicted in FIG. 1*b*. As can be seen in FIG. 1*b*, in this conventional approach, the electrodeposited Cu layer 5 forms a metal overburden 6 on the barrier layer disposed on the top surface of the insulator layer 2. This overburden and portions of the barrier layer 3 are then removed by polishing, yielding the structure shown in FIG. 1*c* which has a planar surface and electrically isolated Cu-filled features. It should be noted that FIG. 1*c* depicts an ideal situation. In practice, it is difficult to obtain a metal layer with an absolutely flat surface, especially over large features. "Dishing" is often observed in such features after a chemical mechanical polishing (CMP) step; dishing is indicted by dotted lines 5*a* in FIG. 1*c*.

Electrodeposition is commonly carried out cathodically in a specially formulated electrolyte containing copper ions as well as additives that control the texture, morphology and plating behavior of the copper layer. A proper electrical contact is made to the seed layer on the wafer surface, typically along the circumference of the round wafer. A consumable Cu or inert anode plate is placed in the electrolyte. Deposition of Cu on the wafer surface can then be initiated when a cathodic potential is applied to the wafer surface with respect to an anode, i.e., when a negative voltage is applied to the wafer surface with respect to an anode plate.

CMP is a widely used method of surface planarization. In CMP, the wafer is loaded on a carrier head, and a wafer surface, with non-planar features, is brought into contact with a polishing pad and an appropriately selected polishing slurry. The pad and the wafer are then pressed together and moved with respect to each other to initiate polishing by way of abrasive particles in the slurry, eventually yielding the desired planar surface.

SUMMARY OF THE INVENTION

The customary approach to achieve the structure following the metal deposition step as depicted in FIG. 1*b* and the structure following the polishing step as depicted in FIG. 1*c* is to use two different processes in two different machines; typically, one process in a first machine is used for deposition of a conductor such as copper, and a second process in a second machine is used for CMP to obtain planarization. Co-pending U.S. patent application Ser. No: 09/201,929, filed on Dec. 1, 1998, titled "METHOD AND APPARATUS FOR ELECTROCHEMICAL MECHANICAL DEPOSITION", relates to a method and an electrochemical mechanical deposition (ECMD) apparatus to achieve both deposition and planarization steps in the same apparatus at the same time or in a sequential manner. Commonly owned U.S. provisional application No. 60/182,100, title MODIFIED PLATING SOLUTION FOR PLATING AND PLANARIZATION, filed Feb. 11, 2000, and commonly owned U.S. patent application Ser. No. 09/544,558, titled MODIFIED PLATING SOLUTION FOR PLATING AND PLANARIZATION AND PROCESS UTILIZING SAME, filed Apr. 6, 2000, relate to plating solution chemistries that can be used to plate and at the same time planarize conductive layers on a substrate. The disclosures of these applications are incorporated herein by reference in their entireties. The present invention relates to an innovative anode assembly design that can be used in a plating apparatus, a plating and planarizing machine, or even in a CMP machine. Our preferred use of this design, however, is in a machine that achieves both plating of a conductive layer and its planarization. Another important application of the present design is in electroetching or etching as will be discussed later in this application.

It is one object of this invention to provide an improved anode assembly which can be used in such a machine. According to the present invention, this object is achieved by using a particular anode assembly to supply a solution for any of a plating operation, a planarization operation, and a plating and planarization operation to be performed on a semiconductor wafer. The anode assembly includes a rotatable shaft disposed within a chamber in which the operation is performed, an anode housing connected to the shaft, and a porous pad support plate attached to the anode housing. The pad support plate has a top surface adapted to support a pad which is to face the wafer, and, together with the anode housing, defines an anode cavity. The anode assembly additionally includes solution delivery structure by which the solution can be delivered to the anode cavity. In one preferred configuration, the solution delivery structure is contained within the chamber in which the operation is performed.

The solution delivery structure includes a passage, having a substantially vertical feed hole and at least one substantially horizontal feed hole, defined in the shaft. In certain constructions, the solution delivery structure may further include a slip ring within which the shaft can rotate. The slip ring defines a slip ring cavity through which the solution can be delivered to the passage. A distribution plate can overlie the passage, and the solution can be routed into the anode cavity by way of the distribution plate. In addition, the solution delivery structure may include tubing extending within the chamber between a solution inlet port defined in a wall of the chamber and the slip ring.

A retaining device can be provided within the chamber to prevent the slip ring from rotating when the rotatable shaft is rotated. In addition a vent may be defined between the anode cavity and the chamber to eliminate accumulation of gas within the anode cavity. The porous pad support plate can be either smaller or larger than the wafer on which the particularly selected operation is performed.

The anode cavity can be adapted to receive a consumable anode providing plating material to the solution. The consumable anode, in this case, is single piece and porous, and the anode assembly further includes filter material by which debris generated during consumption of the anode is retained within the anode cavity. It is possible to make the anode of multiple pieces. In fact, it can consist of balls or pieces. In this configuration, a bypass system is provided in order to permit plating to continue even when the filter material is clogged with debris.

Another feature of the invention is that the anode assembly additionally includes a spindle to which the shaft is mounted and by which rotation may be transmitted to the shaft. A shield is mounted between the shaft and the spindle to prevent leakage of the solution from the chamber.

Other features and advantages will be apparent from the detailed description of the invention which follows.

DESCRIPTION OF THE PREFERRED EMBODIMENTS

Figure 2:
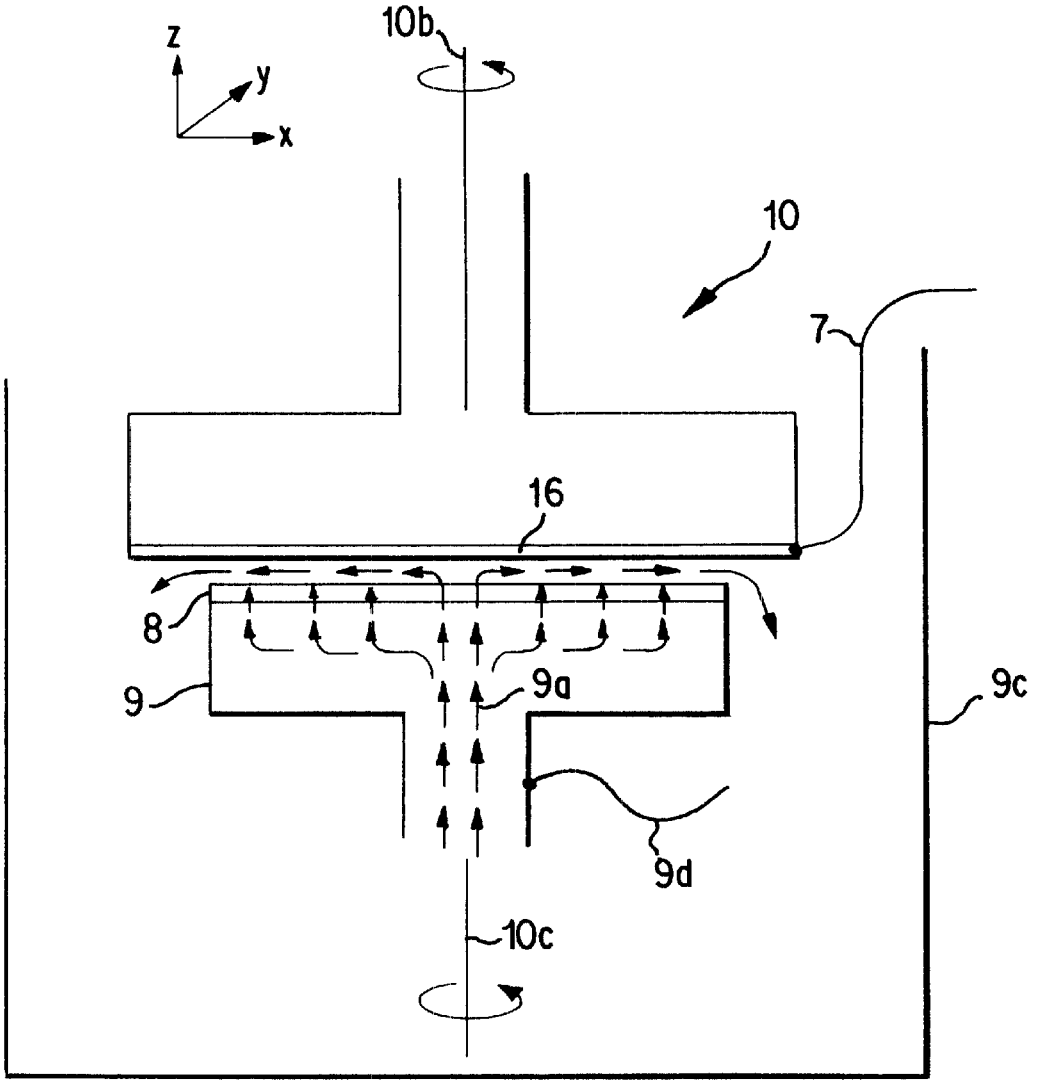
FIG. 2 is a schematic illustration of an overall apparatus design in which an anode assembly according to the present invention can be used.

A general depiction of a plating and planarization apparatus in which the anode assembly of this invention can be used is shown in FIG. 2. The carrier head 10 holds a round semiconductor wafer 16 and, at the same time, provides an electrical lead 7 connected to the conductive lower surface of the wafer. The head can be rotated about a first axis 10*b*. The head can also be moved in the x and z directions represented in FIG. 2. An arrangement which provides movement in the y direction may also be provided for the head.

Certain embodiments of a carrier head that may be used to hold the wafer 16 form the subject matter of co-pending U.S. patent application Ser. No. 09/472,523, titled WORK PIECE CARRIER HEAD FOR PLATING AND POLISHING, filed Dec. 27, 1999.

A pad 8 is provided on top of a round anode assembly 9 across from the wafer surface. The pad 8 may have designs or structures such as those forming the subject matter of co-pending U.S. patent application Ser. No. 09/511,278, titled PAD DESIGNS AND STRUCTURES FOR A VERSATILE MATERIALS PROCESSING APPARATUS, filed Feb. 23, 2000. The top surface of the pad 8 facing the wafer 16 is preferably abrasive. An electrolyte 9*a* containing the material to be plated on the wafer surface is supplied to the wafer surface by the anode assembly 9. Its general path is shown by the arrows. FIG. 2 illustrates that the electrolyte 9*a* is pushed up through holes, pores or other types of openings in the pad 8 to the wafer surface, and then flows over the edges of the pad 8 into a chamber 9*c* to be re-circulated, in a manner which is not shown, after cleaning, filtering, and/or refurbishing. In certain applications, electrolyte may be used just once, in which case there would not be a need to clear and re-circulate it. An electrical lead 9d is connected to the anode assembly 9. The anode assembly 9 can be rotated around a second axis 10*c* at controlled speeds in both the clockwise and counterclockwise directions. Axes 10*b* and 10*c* are substantially parallel to each other. The diameter of the pad 8 in FIG. 2 is smaller than the diameter of the wafer surface exposed to the pad surface. However, the whole wafer surface can be plated and planarized because the carrier head 10 can be translated in the x direction during processing and rotated at the same time. The gap between the wafer surface and the pad is adjustable by moving the carrier head in the z direction. When the wafer surface and the pad are touching, the pressure exerted on the two surfaces can also be adjusted.

Figure 1A:
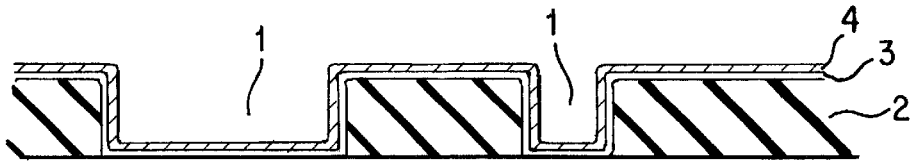
FIG. 1a PRIOR ART
FIG. 1*a* is a partial cross-sectional view of a patterned insulator layer, located on a semiconductor wafer surface, and overlying barrier and seed layers prior to electrodeposition of Cu.
Figure 1B:
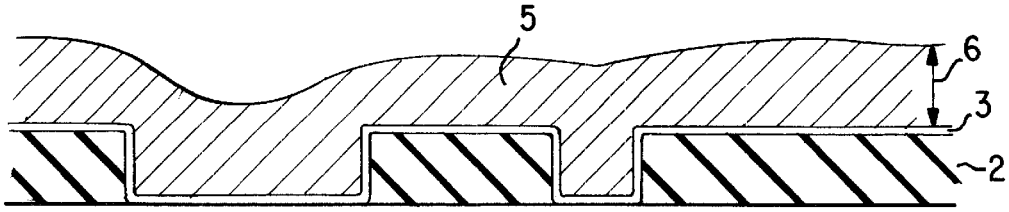
FIG. 1b PRIOR ART
FIG. 1*b* is a view similar to FIG. 1*a* but showing a layer structure and variation of overburden across the substrate after electrodeposition of Cu.
Figure 1C:
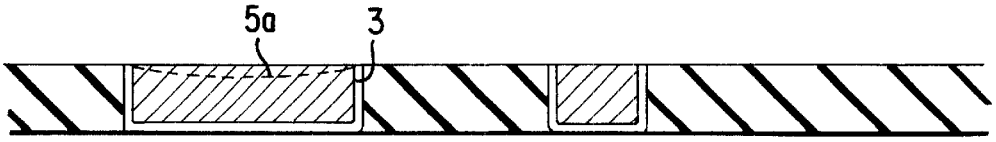
FIG. 1c PRIOR ART
FIG. 1*c* is a view similar to FIG. 1*b* but showing the layer structure after metal and barrier removal and metal planarization to electrically isolate metal-filled features of interest in the patterned insulator layer.

For plating a conductor such as copper on the wafer surface, a potential is applied between the electrical lead 7 to the wafer 16 and the electrical lead 9*d* to the anode assembly 9, making the wafer surface more negative than the anode assembly. Under applied potential, copper plates out of the electrolyte 9*a* onto the wafer surface. By selecting the right pad, selecting the right electrolyte, adjusting the gap between the pad and the wafer surface, and/or by adjusting the pressure with which the pad and the wafer surface touch each other, one can achieve either just plating or both plating and planarization. If only plating is desired, any standard copper plating electrolyte can be utilized and a gap is kept between the wafer surface and the pad. Plating takes place in this way over the whole wafer surface as illustrated in FIG. 1*b*. It should be noted that many types of pads, including abrasive and non-abrasive pads, can be used when just plating is performed. The function of the pad in this case is to deliver the plating solution to the wafer surface, to aggressively stir the solution, and to increase mass transfer in the electrolyte. The small gap (typically 0–6 mm) between the wafer and the pad allows this tool to operate with a small amount of electrolyte that flows at low rate (0.5–5 liters/min) compared to traditional plating tools where anode/cathode spacing is large and filled only with electrolyte. The small gap in the present design and the existence of a pad also improve thickness uniformity of the plated film.

Figure 1D:
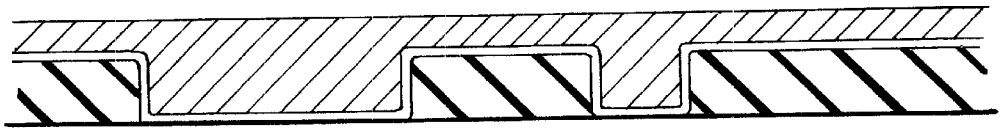
FIG. 1*d* is a view similar to FIG. 1*b* but showing a conductive layer, after deposition in a plating and polishing apparatus, which has a uniform overburden across the substrate surface.
Figure 1E:
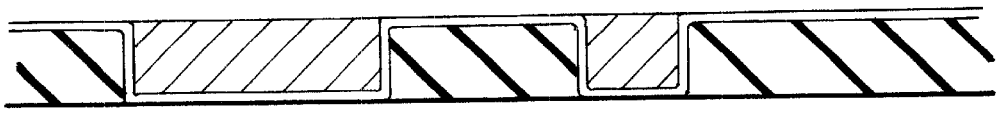
FIG. 1*e* is a view similar to FIG. 1*d* but showing the layer structure resulting when the pressure with which the substrate and the pad surfaces touch each other is increased.

If plating as well as planarization of the copper layer is desired, then a modified plating solution such as that disclosed in the commonly owned applications mentioned above needs to be used in conjunction with a pad that touches the wafer surface. The pad is preferably abrasive. If the pad surface is abrasive and the wafer surface touches the pad surface at low pressures, then plating can freely take place in the holes in the substrate where there is no physical contact between the wafer surface and the pad. The plating rate is reduced on the top surfaces where there is physical contact between the pad and the surface, however. The result is a planar metal deposit with uniform metal overburden across the surface of the substrate as shown in FIG. 1*d*. This is in contrast to the results of a conventional deposition method shown in FIG. 1*b*, in which there is significant variation in metal overburden across the substrate. If the pressure with which the substrate and the pad surfaces touch each other is further increased, then it is possible to obtain plating just in the holes, and "dishing" is avoided, as is apparent from FIG. 1*e*. In this case, the increased physical contact on the high points of the substrate surface does not allow accumulation of a metal layer on these regions.

Reversing the applied voltage polarity in the set-up of FIG. 2 can provide electro-etching or electro-polishing of the wafer surface, if desired. The anode assembly of the present invention can also be used in chemical etching and electrochemical etching/polishing of substrates. The term "anode" is customarily used for an electrode that receives positive (+) potential. However, in this application, we describe an anode assembly which is used as an anode when the machine is used for material deposition. For chemical etching applications, no voltage is applied to the anode assembly. For electrochemical etching/polishing (also called electro-etching/polishing), a negative (−) voltage is applied to the anode assembly.

For etching applications, the anode assembly becomes a device by which the etching solution can be contained and delivered in a uniform manner to the wafer surface. The etching solution is typically acidic. It is fed into the anode cavity and goes up through the holes in the top plate and the pad and makes physical contact with the wafer surface. The pad hole pattern, a small gap between the wafer and the pad, and the rotation of the anode and the wafer are all adjusted to obtain a uniform material etching rate on the wafer surface. It should be noted that there is no need for a soluble anode for this application and therefore the design of FIG. 3 can be used.

For electro-etching/polishing applications, the electrolyte is changed to an electro-etching electrolyte that is appropriate for the material to be removed from the wafer surface. In this case, a negative voltage is applied to the anode assembly with respect to the wafer surface. The electrolyte flow is regulated through the design of the holes in the anode plate and in the pad. The hole pattern and the movement of the anode plate and the wafer are optimized to obtain uniform material removal from the wafer surface.

The anode assembly of the present invention is a versatile design that can be used with an inert as well as a consumable anode. This anode assembly has the ability to rotate at controlled speeds in both directions and the mechanical strength to support a pad against which the wafer surface can be pushed with controlled force. It has the capability of receiving, containing, delivering, and distributing process fluids. The anode assembly of this invention can be used for an electrodeposition process, as well as for a plating and planarization process or an ECMD process. The design may even be used in a CMP tool.

Figure 3:
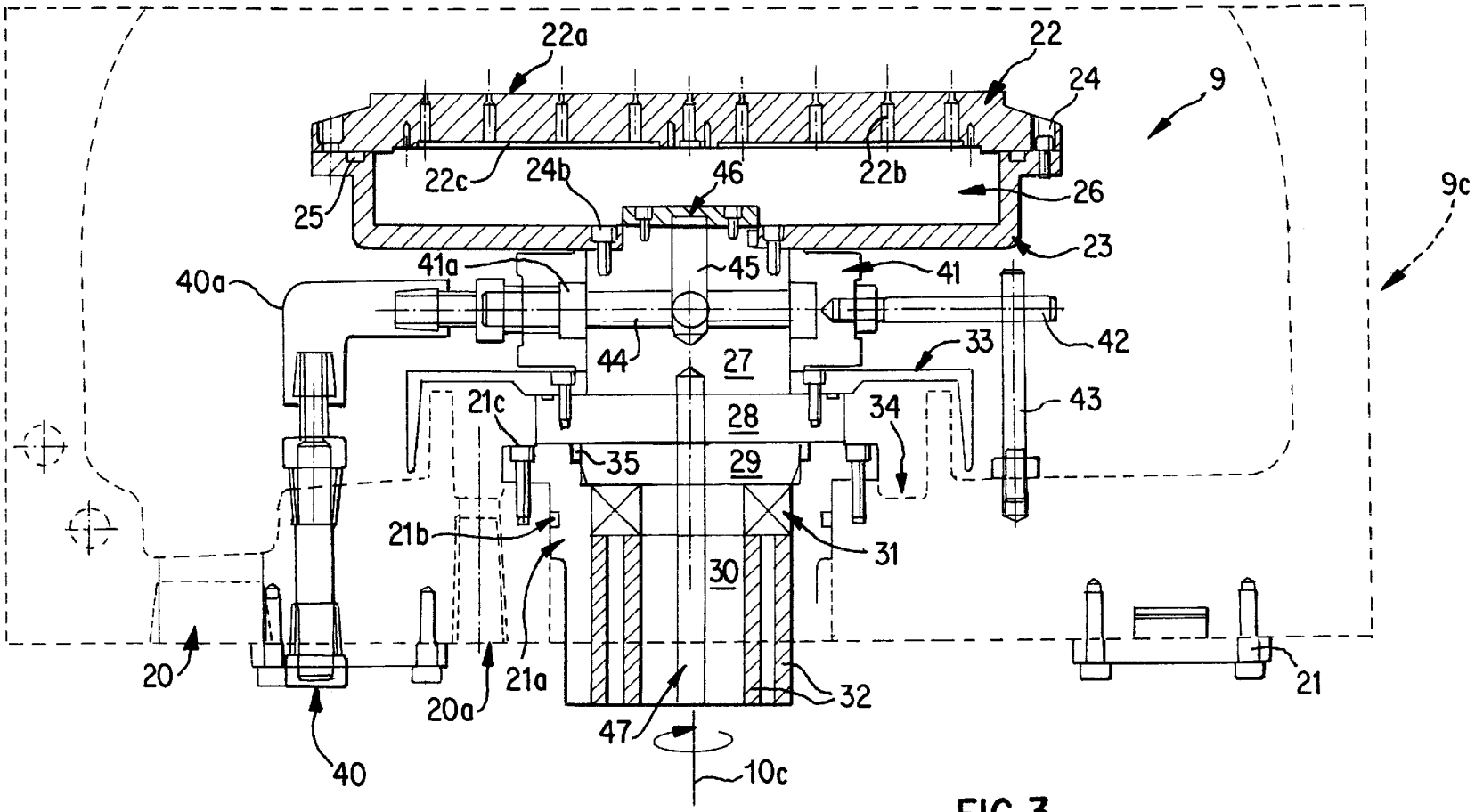
FIG. 3 is an enlarged view, partly in section, of a first anode assembly embodiment according to the invention.

A detailed illustration of the anode assembly 9 mounted in a chamber 9*c* is shown in FIG. 3. The body of the chamber 9*c* is represented in phantom in FIG. 3 for clarity. The chamber 9*c* is made of a material that is inert and stable in the chemicals used for the plating and/or planarization processes. In other words, the chamber material does not introduce any impurities or particulate into the process solutions. Polymeric materials, such as polyvinylidenedifluoride (PVDF) or polyethylene, are especially suited for constructing the chamber 9*c*. The important functions of the chamber 9*c* are to safely and cleanly contain and collect the chemical solution(s) emanating from the anode assembly, and to direct the collected solutions to a return port 20 through which they can be sent to a cleaning, filtering, and/or refurbishing loop (not shown). The chamber is attached to a sturdy frame (not shown) through attachment brackets 21 and a plate (not shown) which can be moved in x, y, and z directions so that the chamber can be centered and the anode surface can be made parallel to the wafer surface. A metallic sleeve 21*a* is placed through the hole in the bottom center of the chamber 9*c* and is attached to the bottom of the chamber by bolts 21*c*. A seal 21*b* between the wall of the hole and the metallic sleeve 21*a* assures that no chemical solutions leak out of the chamber 9*c*.

The anode assembly 9 includes various components. The pad support plate 22 is a thick circular plate over which the pad 8 (FIG. 2) can be mounted. In the design of FIG. 3, the pad support plate 22 is made of a metal such as Ti and acts as the inert anode. The top surface 22*a* of the support plate 22 is machined flat and is preferably coated with a highly conducting inert material such as platinum (Pt). The bottom surface 22*c* is also coated with Pt. The pad support plate 22 is attached to the anode housing 23 through bolts 24. An 0-ring placed in the circular groove 25 seals the pad support plate and the anode housing together, forming the anode cavity 26. In the embodiment of FIG. 3, an electrolyte which forms the subject matter of both our commonly owned provisional application No. 60/182,100 and our commonly owned U.S. patent application Ser. No. 09/544,558, each of which is referred to above, is used. This particular solution provides a supply of Cu which is plated out of the electrolyte. In an alternative embodiment, a consumable anode can be placed in the anode cavity 26 as will be discussed later in connection with FIG. 4. The holes 22*b* in the pad support plate 22 make the pad support plate porous in that these holes allow fluids pumped under pressure into the anode cavity 26 to go up through the pad support plate 22 and reach the pad mounted on the surface 22*a*. The fluids then can go up through holes/asparities that may be provided in the pad and make physical contact with the substrate surface placed across from the pad.

The anode housing 23 is bolted to a rotatable shaft 27 through bolts 24*b*. Machined as an extension of the shaft 27 are an upper flange 28, a lower flange 29, and a spindle 30, all made from a single piece of strong and conductive material such as titanium. The spindle 30 extends down through the metallic sleeve 21*a* and is coupled to an electric motor (not shown) which can rotate the whole assembly around the second axis 10*c* in a clockwise or a counter-clockwise direction at various rotation rates (up to about 800 rpm) that can be controlled by a computer. A bearing 31 is disposed around the upper portion of the spindle 30 right below the lower flange 29, between the wall of the metallic sleeve 21*a* and the spindle 30. The bearing 31 is supported by cylindrical ring spacers 32 which extend down and rest against another bearing (not shown) similar to bearing 31, only around the lower portion of the spindle 30. A shield 33 is bolted on the upper flange 28 to prevent chemical solutions from reaching the lower flange 29, the spindle 30 and the bearing 31. Normally, the plating/planarization solution emanating from the holes 22*b* in the pad support plate 22 is delivered, through openings in the pad (not shown) attached to the surface 22*a*, to the interface between the pad and the substrate surface. The solution is then pushed radially out by the rotating anode assembly 9 and the substrate holder. Hitting the vertical or at least upwardly oriented side walls of the chamber 9*c*, the solution flows towards the return port 20. If for any reason some solution finds its way past the shield 33, it collects in well 34 and flows out through a secondary return port 20*a*. A ball seal 35 is employed to further protect the lower flange 29, the spindle 30 and the bearing 31 from the electrolyte chemical solutions.

The chemical solution is pumped into the system through a solution inlet port 40 defined in a wall of the chamber 9*c*. The solution passes through this inlet port, which as shown is formed by a hole in the bottom wall of the chamber 9*c*, and is routed by tubing 40*a* to a slip ring 41, placed around the shaft 27, within which the shaft 27 can rotate. The slip ring 41 is made of a low friction, inert material, such as polytetrafluoroethelyne (PTFE or TEFLON), and is held stationary by a set of pins. This set of pins includes a horizontal alignment pin 42, which is attached to the slip ring 41, and a pair of vertical alignment pins 43, which are attached to the bottom of the chamber 9*c*. The tip of the horizontal alignment pin 42 fits through a space between the two vertical alignment pins 43 and, therefore, the set of pins 42 and 43 forms a retaining device within the chamber 9*c* which does not allow the slip ring 41 to rotate when the shaft 27 is rotated by the electric motor coupled to the spindle 30.

The solution fed from the inlet port 40 arrives into the slip ring cavity 41*a* and then is pushed through the horizontal feed holes 44, up through the vertical feed hole 45, and into the distribution plate 46. The holes 44 and 45 thus form a passage in the shaft 27 for the solution. Multiple horizontal feed holes can be machined into the shaft 27. The design in FIG. 3 uses four such holes. The distribution plate 46 overlies the passage in the shaft, and also has a number of small horizontal holes or slots machined in it (not shown) which route the solution into the anode cavity 26.

In the design of FIG. 3, the mechanism that delivers the solution into the anode cavity 26, i.e. the solution delivery structure, is contained in the chamber 9*c*. This is preferable because any leakage of solution from, for example, the slip ring cavity 41*a* or the connectors and tubing 40*a* that carry the solution from the inlet port 40 into the ring cavity 41*a* would be contained by the chamber 9*c*, and the leaked solution would be directed to the return port 20. Alternately, however, the solution can be fed into the anode cavity 26 through a delivery hole 47 in the center of the spindle 30. In FIG. 3, this delivery hole 47 is not in use and therefore has not been connected to the vertical feed hole 45. For a design using the delivery hole 47, the inlet port 40, the slip ring 41 and the horizontal feed holes 44 are eliminated and the delivery hole 47 is connected to the vertical feed hole 45. In this case, the solution needs to be fed into the delivery hole 47 from outside the chamber 9*c*.

The electrical contact to the anode assembly of FIG. 3 can be made anywhere on the metallic structure. The preferred way, however, is making this electrical contact to the lower portion (not shown) of the metallic spindle 30 using an ordinary rotary contact. Any potential applied to the metallic spindle is carried to the pad support plate 22 through the metallic parts which are physically and electrically attached together using metallic bolts. In operation, when an anodic potential is applied to the anode assembly of FIG. 3, the top and bottom surfaces of the pad support plate 22 as well as the inner surfaces of the holes 22*b* may act as the inert anode since these surface portions are coated with Pt. The pad attached to the top surface 22*a* of the pad support plate 22 may physically and electrically block most of this top surface depending upon the method of pad attachment. In this case, only the portions of the top surface 22*a* physically touching the electrolyte would act as part of the anode. Furthermore, the inner surface of the anode housing 23 may also be coated with Pt to increase the active inert anode surface area. Only portions of anode surfaces coated with Pt would carry majority of the anodic current because un-coated Ti surfaces would contain a high-resistance oxide layer. Therefore, the active anode surface area can be controlled by choosing the areas to be coated by Pt.

Figure 4:
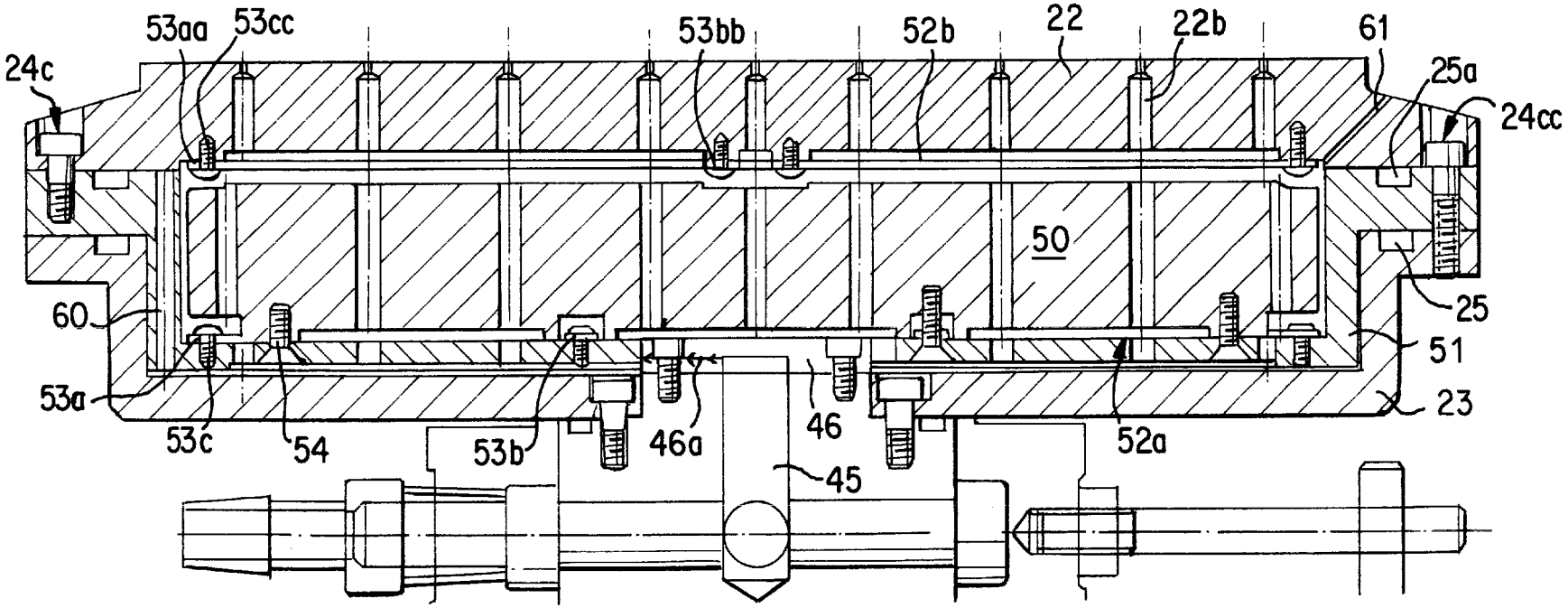
FIG. 4 is an enlarged view, also partly in section, of a second anode assembly embodiment according to the invention in which a consumable anode can be used.

FIG. 4 is a sectional view of the top portion of a second embodiment of the anode assembly as adapted to the use of a consumable anode such as a copper anode. In this design, a copper anode plate 50 is first attached to a base plate 51 and then the whole anode plate and base plate assembly is placed in the anode cavity. Alternatively, copper pieces, balls, and/or nuggets may also be used instead of a plate. The pad support plate 22, the base plate 51 and the anode housing 23 are then attached together by bolts 24*c* and 24*cc*. O-rings are placed in grooves 25 and 25*a* providing seals between the anode housing 23 and the base plate 51, and the pad support plate 22 and the base plate 51, respectively.

It is apparent from a comparison of FIGS. 3 and 4 that, in the first embodiment, the base plate 51 may be omitted, since an anode plate is not used in the first embodiment.

Figure 4A:
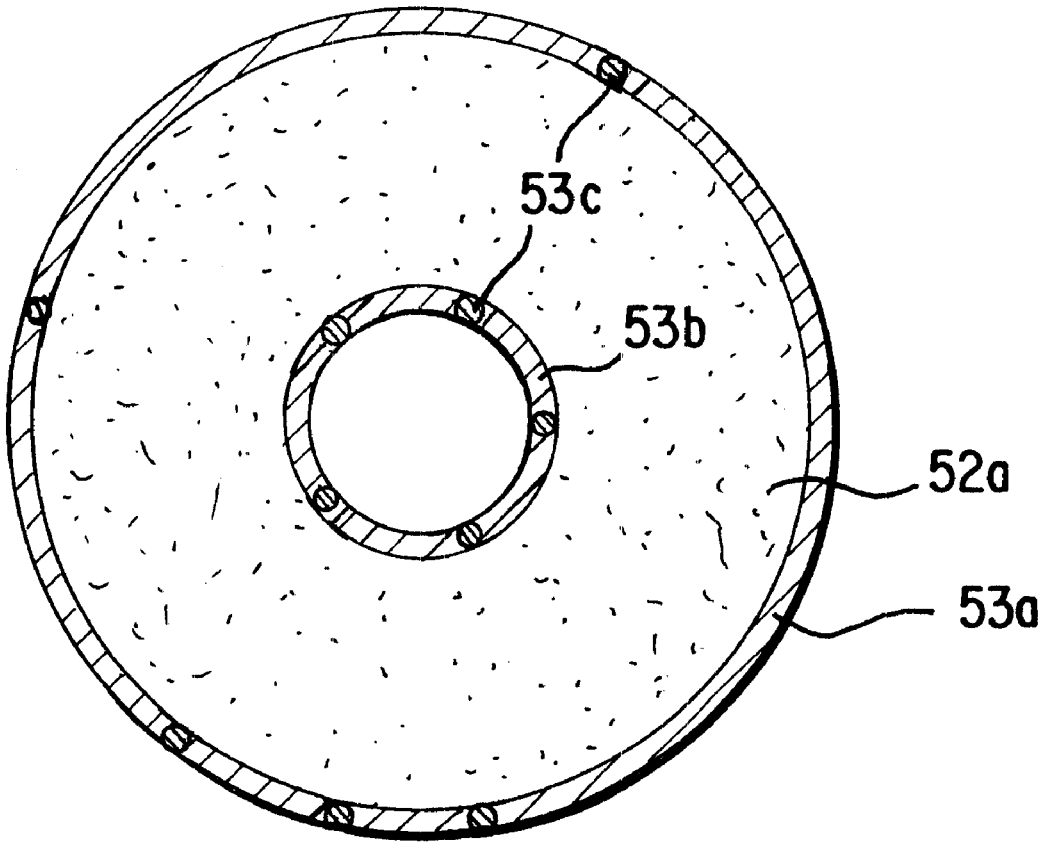
FIG. 4*a* is a top view, partly in section, of part of the anode assembly shown in FIG. 4.

An anode bag is a filter formed from a type of material that is commonly used in electroplating processes using consumable anodes. The bag is typically wrapped around the anode. It lets the solution and the electrical current pass through, but traps particles and sludge that result from reactions on the anode. The bag is occasionally opened up and cleaned. In the design of FIG. 4, the lower anode bag 52*a* is ring shaped and is attached to the top surface of the bottom of the base plate 51 using lower outer ring 53*a* and lower inner ring 53*b* which are bolted to the base plate with bolts 53*c*. For clarity, FIG. 4*a* provides a view, from above, of the lower anode bag 52*a*, and illustrates the outer ring 53*a*, the inner ring 53*b* and some of the bolts 53*c* used to attach the rings and the anode bag to the base plate 51 in section.

After the lower anode bag 52*a* is attached to the base plate 51, the base plate 51 is attached to the anode plate 50 using bolts 54. The assembly is then placed into the anode housing 23.

Upper anode bag 52*b* is in the shape of a full circle and it is pushed against the lower surface of the pad support plate 22 with the upper outer ring 53*aa* and the upper inner ring 53*bb* which are attached to the pad support plate 22 through bolts 53*cc*.

The pressurized plating or plating/planarization solution comes through the vertical feed hole 45 into the distribution plate 46. The solution then moves radially out through small horizontal holes/channels in the distribution plate 46 as shown with arrows 46*a* into a volume defined between the anode housing 23 and the base plate 51. The solution then passes through holes formed in the base plate 51 and through the lower anode bag 52*a*.

After going through the lower anode bag 52*a*, the solution goes through the holes in the anode plate 50, through the upper anode bag 52*b* and through the holes 22*b* in the support plate 22. This design allows the use of a consumable anode, and the anode bag is made an integral part of the anode assembly.

During use, the anode plate 50 is gradually consumed or shrunk down. The anode plate 50 must be replaced after 5,000–10,000 plating operations depending on its size.

In the design of FIG. 4, there is also a bypass system that allows at least some of the solution to bypass the two filter bags. When and if the anode bag at the top is clogged up because of sludge generated on the anode, the solution can bypass the clogged up bag through an opening 60, and plating can continue, since current can still pass through the physically clogged-up filter bag. The opening 60 discharges into a volume defined between the upper anode bag 52*b* and the pad support plate in a manner which is not shown.

The design of FIG. 4 also includes a bubble elimination system. In operation, it is possible that gas bubbles will be trapped and accumulate near the lower surface of the upper anode bag 52*b*. This, then, would increase the resistance for the anodic current. To avoid such an accumulation of gas bubbles, small diameter holes or vents are provided through the pad support plate 22. One such small hole 61 is schematically shown in FIG. 4.

Although the consumable anode shown in FIG. 4 is in the form of a plate 50, the anode may take other forms, such as that of a copper rod, copper pieces or nuggets, for example. It is also possible to use other types of soluble anode materials instead of copper in the anode assembly if other materials are plated using the present tool. Examples of such materials are nickel and gold.

The active anode area in the design of FIG. 4 can be controlled. If all metallic surfaces touching the electrolyte are passivated, for example by the presence of a titanium-oxide layer, then the current would pass through the Cu anode only. If some areas of the titanium (Ti) structure are plated with Pt, then these areas would act as additional anodic areas that are inert.

The anode assembles shown in FIGS. 3 and 4 are appropriate for structures in which the pad 8 and at least the pad support plate of the anode assembly and the pad 8 are smaller than the substrate or wafer 16. In these cases, the carrier head design is like that forming the subject matter of co-pending U.S. patent application Ser. No. 09/472,523 mentioned above. During plating and polishing, the carrier head rotates and moves right and left so as to be able to process the whole wafer or substrate surface.

Figure 5:
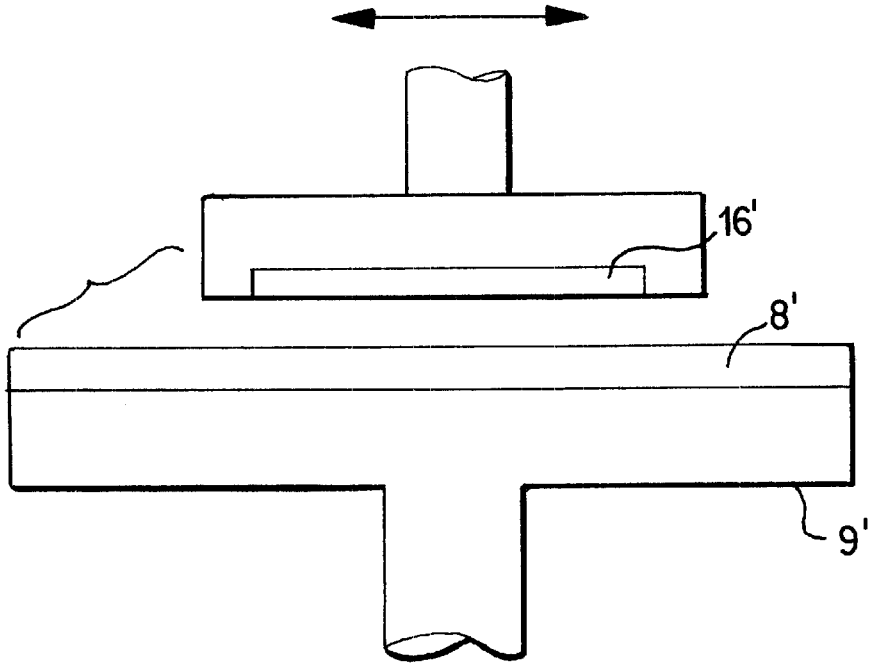
FIG. 5 is a schematic illustration of an anode assembly such as that shown in either FIG. 3 or FIG. 4 and dimensioned so that at least a portion thereof is larger than the substrate.

FIG. 5 shows a structure in which at least the pad 8' and the pad support plate of the anode assembly 9' are larger than the substrate or wafer 16'. In this case, the carrier head design must be different. Clamps can not be used. The wafer needs to be held at its edge.

The anode design according to the present invention may even be used for CMP. In this case, instead of a plating or a plating/planarization solution, a CMP solution could be used in conjunction with an abrasive pad. Alternatively, a CMP slurry with abrasive particles could be used in conjucnction with a regular CMP pad. Voltage could still be applied during CMP to help oxidize or etch the substrate surface in the CMP solution to help polishing and material removal.

The chamber 9*c* that is presently used is a two-volume vertical chamber with a square or rectangular cross section. Plating or polishing is performed, or both plating and polishing are performed, in a bottom or lower volume 100 of the chamber 9*c*. A rinsing and drying operation is performed in a top or upper volume 102 of the chamber. The upper and lower volumes are schematically shown in FIG. 7.

Figure 6:
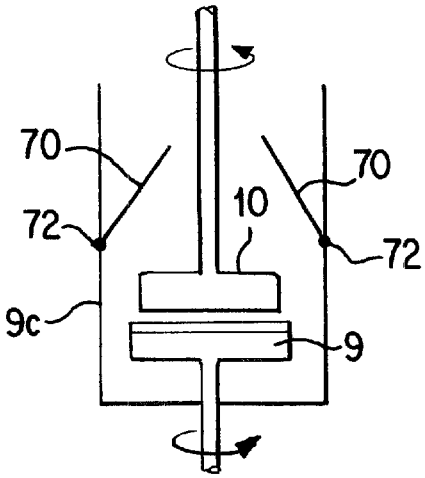
FIG. 6 is a highly schematic illustration of a carrier head of the overall apparatus in a plating/polishing position.
Figure 7:
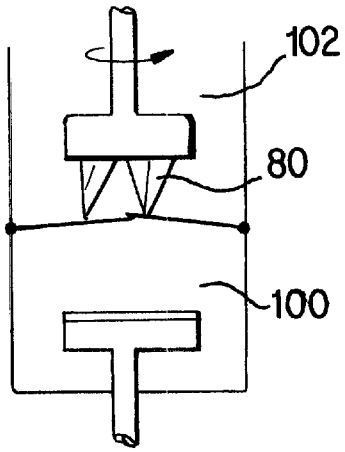
FIG. 7 is an illustration similar to FIG. 6 but in which the carrier head is shown in a rinse/dry position.

After the plating operation, the polishing operation, or the combined plating and polishing operation has been completed, the carrier head 10 is moved upward from a plating/polishing position in the lower volume as shown in FIG. 6 to a rinse/dry position in the upper volume as shown in FIG. 7. The anode assembly remains in the lower volume 100. Once the carrier head has been moved into the rinse/dry position, flaps 70, which are mounted to the wall or walls of the chamber by way of pivots 72, pivot downwardly into a rinse position to seal off the upper and lower volumes. Water or another appropriate fluid, which is used to rinse off the carrier head, is supplied through conduits defined in the flaps 70 so that spray jets 80, which rinse off the carrier head, are formed. After it is rinsed off, the carrier head can be spin dried by rotation thereof around the first axis 10*b* indicated in FIG. 2. The water shed from the carrier head can be removed in any appropriate manner such as, for example, by way of gutters defined in the walls of the container 9*c* adjacent to the locations of pivots 72.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

We claim:

1. An anode assembly which can be used to supply a solution for any of a plating operation, a planarization operation, and a plating and planarization operation to be performed on a workpiece comprising:

a rotatable shaft disposed within a chamber in which the operation is performed and through which the solution can pass, an anode housing on said shaft, a porous plate which, together with said anode housing, defines an anode cavity within which there is an anode and from which the solution can be delivered through said porous plate to a surface of the workpiece, and solution delivery structure by which said solution can be delivered to said anode cavity, wherein said plate has a top surface adapted to support a pad which is to face the workpiece.

2. An anode assembly according to claim 1, wherein said solution delivery structure is contained within said chamber in which the operation is performed.

3. An anode assembly according to claim 1, wherein said solution delivery structure includes a passage defined in said shaft.

4. An anode assembly according to claim 3, wherein said passage includes a substantially vertical feed hole and at least one substantially horizontal feed hole defined in said shaft.

5. An anode assembly according to claim 3, wherein said solution delivery structure further comprises a slip ring within which said shaft can rotate, said slip ring defining a slip ring cavity through which said solution can be delivered to said passage.

6. An anode assembly according to claim 5, wherein said delivery structure further comprises a distribution plate overlying said passage by which the solution can be routed into said anode cavity.

7. An anode assembly according to claim 1, wherein said porous plate is smaller than the workpiece on which said operation is performed.

8. An anode assembly according to claim 1, wherein said solution delivery structure is configured to deliver a deposition solution and the assembly is used to deposit material on said workpiece.

9. An anode assembly according to claim 1, wherein said solution delivery structure is configured to deliver an etching solution which is delivered to the surface of said workpiece without voltage application.

10. An anode assembly according to claim 1, wherein said solution delivery structure is configured to deliver an electro-etching solution by which material can be removed from the surface of said workpiece.

11. An anode assembly which can be used to supply a solution for any of a plating operation, a planarization operation, and a plating and planarization operation to be performed on a semiconductor wafer comprising:

a rotatable shaft disposed within a chamber in which the operation is performed, an anode housing on said shaft, a porous plate on said anode housing, having a top surface adapted to support a pad which is to face the wafer, and, together with said anode housing, defining an anode cavity, and solution delivery structure by which said solution can be delivered to said anode cavity, wherein said solution delivery structure is contained within said chamber in which the operation is performed, wherein said solution delivery structure includes a passage defined in said shaft, wherein said solution delivery structure further comprises a slip ring within which said shaft can rotate, said slip ring defining a slip ring cavity through which said solution can be delivered to said passage, wherein said delivery structure further comprises a distribution plate overlying said passage by which the solution can be routed into said anode cavity, and wherein said solution delivery structure further comprises tubing extending within said chamber between a solution inlet port defined in a wall of said chamber and said slip ring.

12. An anode assembly which can be used to supply a solution for any of a plating operation, a planarization operation, and a plating and planarization operation to be performed on a semiconductor wafer comprising:

a rotatable shaft disposed within a chamber in which the operation is performed, an anode housing on said shaft, a porous plate on said anode housing, having a top surface adapted to support a pad which is to face the wafer, and, together with said anode housing, defining an anode cavity, solution delivery structure by which said solution can be delivered to said anode cavity, said solution delivery structure being contained within said chamber in which the operation is performed, including a passage defined in said shaft, and having a slip ring within which said shaft can rotate, said slip ring defining a slip ring cavity through which said solution can be delivered to said passage, and a retaining device provided within the chamber which prevents the slip ring from rotating when the rotatable shaft is rotated.

13. An anode assembly which can be used to supply a solution for any of a plating operation, a planarization operation, and a plating and planarization operation to be performed on a semiconductor wafer comprising:

a rotatable shaft disposed within a chamber in which the operation is performed, an anode housing on said shaft, a porous plate on said anode housing, having a top surface adapted to support a pad which is to face the wafer, and, together with said anode housing, defining an anode cavity, and solution delivery structure by which said solution can be delivered to said anode cavity, wherein a vent is defined between said anode cavity and said chamber to eliminate accumulation of gas within said anode cavity.

14. An anode assembly which can be used to supply a solution for any of a plating operation, a planarization operation, and a plating and planarization operation to be performed on a semiconductor wafer comprising:

a rotatable shaft disposed within a chamber in which the operation is performed, an anode housing on said shaft, a porous plate on said anode housing, having a top surface adapted to support a pad which is to face the wafer, and, together with said anode housing, defining an anode cavity, and solution delivery structure by which said solution can be delivered to said anode cavity, wherein said porous pad support plate is larger than the wafer on which said operation is performed.

15. An anode assembly which can be used to supply a solution for any of a plating operation, a planarization operation, and a plating and planarization operation to be performed on a semiconductor wafer comprising:

a rotatable shaft disposed within a chamber in which the operation is performed, an anode housing on said shaft, a porous pad support plate on said anode housing, having a top surface adapted to support a pad which is to face the wafer, and, together with said anode housing, defining an anode cavity, and solution delivery structure by which said solution can be delivered to said anode cavity, wherein said anode cavity is adapted to receive a consumable anode providing plating material to said solution.

16. An anode assembly according to claim 15, wherein said solution delivery structure includes a passage defined in said shaft.

17. An anode assembly according to claim 16, wherein said passage includes a substantially vertical feed hole and at least one substantially horizontal feed hole defined in said shaft.

18. An anode assembly according to claim 16, wherein said solution delivery structure further comprises a slip ring within which said shaft can rotate, said slip ring defining a slip ring cavity through which said solution can be delivered to said passage.

19. An anode assembly according to claim 18, wherein said delivery structure further comprises a distribution plate closing off said passage by which the solution can be routed into said anode cavity.

20. An anode assembly according to claim 19, wherein said solution delivery structure further comprises tubing extending within said chamber between a solution inlet port defined in said chamber and said slip ring.

21. An anode assembly according to claim 18, and further comprising a retaining device provided within the chamber which prevents the slip ring from rotating when the rotatable shaft is rotated.

22. An anode assembly according to claim 15, wherein a vent is defined between said anode cavity and said chamber to eliminate accumulation of gas within said anode cavity.

23. An anode assembly according to claim 15, wherein said porous pad support plate is smaller than the wafer on which said operation is performed.

24. An anode assembly according to claim 15, wherein said porous pad support plate is larger than the wafer on which said operation is performed.

25. An anode assembly according to claim 15, wherein said consumable anode is porous, and further comprising filter material by which debris generated during consumption of the anode is retained within said anode cavity.

26. An anode assembly according to claim 25, and further comprising a bypass system permitting plating to continue even when said filter material is clogged with said debris.

27. An anode assembly according to claim 15, wherein said solution delivery structure is configured to deliver a deposition solution and the assembly is used to deposit material on said semiconductor wafer.

28. An anode assembly according to claim 15, wherein said solution delivery structure is configured to deliver an etching solution which is delivered to a surface of said semiconductor wafer without voltage application.

29. An anode assembly according to claim 15, wherein said solution delivery structure is configured to deliver an electro-etching solution by which material can be removed from a surface of said semiconductor wafer.

30. An anode assembly which can be used to supply a solution for any of a plating operation, a planarization operation, and a plating and planarization operation to be performed on a semiconductor wafer comprising:

a rotatable shaft disposed within a chamber in which the operation is performed, an anode housing on said shaft, a porous pad support plate on said anode housing, having a top surface adapted to support a pad which is to face the wafer, and, together with said anode housing, defining an anode cavity, solution delivery structure by which said solution can be delivered to said anode cavity, and a shield to prevent leakage of the solution from said chamber.

31. An anode assembly according to claim 30, wherein said solution delivery structure is configured to deliver a deposition solution and the assembly is used to deposit material on said semiconductor wafer.

32. An anode assembly according to claim 30, wherein said solution delivery structure is configured to deliver an etching solution which is delivered to a surface of said semiconductor wafer without voltage application.

33. An anode assembly according to claim 30, wherein said solution delivery structure is configured to deliver an electro-etching solution by which material can be removed from a surface of said semiconductor wafer.

34. An anode assembly which can be used to supply a solution for any of a plating operation, a planarization operation, and a plating and planarization operation to be performed on a workpiece comprising:

a rotatable shaft disposed within a chamber in which the operation is performed and through which the solution can pass, an anode housing on said shaft, a porous plate which, together with said anode housing, defines an anode cavity within which there is an anode and from which the solution can be delivered through said porous plate to a surface of the workpiece, and solution delivery structure by which said solution can be delivered to said anode cavity, wherein said workpiece is a semiconductor wafer.

35. An anode assembly which can be used to supply a solution for any of a plating operation, a planarization operation, and a plating and planarization operation to be performed on a workpiece comprising:

a shaft disposed within a chamber in which the operation is performed, an anode housing on said shaft, a porous plate which is at least partially coated with a conducting inert material and which, together with said anode housing, defines an anode cavity from which the solution can be delivered through said porous plate to a surface of the workpiece, and solution delivery structure by which said solution can be delivered to said anode cavity.

36. An anode assembly according to claim 35, wherein said solution delivery structure is contained within said chamber in which the operation is performed.

37. An anode assembly according to claim 35, wherein said solution delivery structure includes a passage defined in said shaft.

38. An anode assembly according to claim 37, wherein said passage includes a substantially vertical feed hole and at least one substantially horizontal feed hole defined in said shaft.

39. An anode assembly according to claim 37, wherein said solution delivery structure further comprises a slip ring within which said shaft can rotate, said slip ring defining a slip ring cavity through which said solution can be delivered to said passage.

40. An anode assembly according to claim 39, wherein said delivery structure further comprises a distribution plate overlying said passage by which the solution can be routed into said anode cavity.

41. An anode assembly according to claim 40, wherein said solution delivery structure further comprises tubing extending within said chamber between a solution inlet port defined in a wall of said chamber and said slip ring.

42. An anode assembly according to claim 39, and further comprising a retaining device provided within the chamber which prevents the slip ring from rotating when the rotatable shaft is rotated.

43. An anode assembly according to claim 35, wherein a vent is defined between said anode cavity and said chamber to eliminate accumulation of gas within said anode cavity.

44. An anode assembly according to claim 35, wherein said porous plate is smaller than the workpiece on which said operation is performed.

45. An anode assembly according to claim 35, wherein said porous plate is larger than the workpiece on which said operation is performed.

46. An anode assembly according to claim 35, wherein said solution is a deposition solution and the assembly is used to deposit material on said workpiece.

47. An anode assembly according to claim 35, wherein said solution is an etching solution which is delivered to the surface of said workpiece without voltage application.

48. An anode assembly according to claim 35, wherein said solution is an electro-etching solution by which material can be removed from the surface of said workpiece.

49. An anode assembly according to claim 48, wherein electro-etching occurs when said surface of said workpiece is more positively charged than said porous plate.

50. An anode assembly according to claim 35, wherein said conducting inert material is platinum.

51. An anode assembly according to claim 35, wherein said workpiece is a semiconductor wafer.

52. An anode assembly according to claim 35, wherein said shaft is rotatable.

53. An anode assembly according to claim 35, wherein said plate has a top surface adapted to support a pad which is to face the wafer.

* * * * *